US006179656B1

(12) United States Patent
Wong

(10) Patent No.: US 6,179,656 B1
(45) Date of Patent: Jan. 30, 2001

(54) GUIDE TUBE FOR COUPLING AN END CONNECTOR TO A COAXIAL CABLE

(76) Inventor: Shen-Chia Wong, No. 10, Lane 121, Li-Der Road, Peito District, Taipei (TW)

( * ) Notice: Under 35 U.S.C. 154(b), the term of this patent shall be extended for 0 days.

(21) Appl. No.: 09/351,629

(22) Filed: Jul. 12, 1999

(51) Int. Cl.[7] ..... H01R 9/05
(52) U.S. Cl. ..... 439/578
(58) Field of Search ..... 439/578, 583, 439/584

(56) References Cited

U.S. PATENT DOCUMENTS 3,223,954 * 12/1965 Mateer ..... 439/578
3,845,453 * 10/1974 Hemmer ..... 439/578
4,925,403 * 5/1990 Zorzy ..... 439/578
5,232,377 * 8/1993 Leibfried, Jr. ..... 439/578
5,820,408 * 10/1998 Wang ..... 439/578
5,888,094 * 3/1999 Kubota et al. ..... 439/583

* cited by examiner

*Primary Examiner*—Khiem Nguyen
*Assistant Examiner*—Hae Moon Hyeon
(74) *Attorney, Agent, or Firm*—Dougherty & Troxell

(57) ABSTRACT

A guide tube includes of a body having a beveled surface at one end that is inserted into the hollow body of a coaxial cable end connector, with a centered lengthwise tubular passage formed in the other end into which is inserted the coaxial cable conductors. The present arrangement enables the easy and efficient insertion of the conductors onto the body of the end connector, and removable of the thereby guide tube increasing the working efficiency of the installation personnel as an optimized tool capable of continuous and repeated usage.

3 Claims, 8 Drawing Sheets

GUIDE TUBE FOR COUPLING AN END CONNECTOR TO A COAXIAL CABLE

BACKGROUND OF THE INVENTION

1. Field of the Invention

The invention herein relates to a guide tube utilized as a tool capable of guiding the assembly of coaxial cable conductors to an end connector in a simple operation and, furthermore, the said guide tube can be carried by working personnel and is capable of continuous and repeated usage.

2. Description of the Prior Art

In cable television systems(CATV),subscription television systems(STV), and master antenna television systems (MATV), terminal, and other systems, the signals are transmitted by means of coaxial cable. Referring to FIG. 1, the conventional coaxial cable connector of such systems is comprised of the coaxial cable 10 itself and an end connector 11; the installation personnel must effectively insert the cable 10 into the end connector 11 such that the center conductor 12 and the dielectric 13 are inserted through the inside of a hollow body 14 of the end connector 11, while the braided conductor 15 and the outer jacket 16 are sleeved around the extended rear section 17 of the hollow body 14 and, finally, a ring 18 is crimped over the coaxial cable 10 to bind it firmly to the extended rear section 17; however, since the inner diameter of the said hollow body 14 is slightly larger that the outer diameter of the dielectric 13, the installation personnel have an extremely difficult time inserting the dielectric 13 into the hollow body 14; furthermore, if the braided conductor 15 is in a state of disarray, the installation personnel experience further difficulty while inserting the dielectric 13 through the hollow body 14, which poses tremendous installation problems; as such, the industry is currently awaiting a solution to the said shortcomings to increase competitiveness.

In view of the said situation, the inventor of the inventor herein conducted intensive research based on many years of experience accumulated while engaged in the production and marketing of related products which, following continuous testing and refinements, finally culminated in the development the guide tube of invention herein.

SUMMARY OF THE INVENTION

Therefore, the primary objective of the invention herein is to provide a guide tube that is ensleeved over the coaxial cable conductors, thereby enabling the guide tube to be capable of easily inserting the conductors and dielectric of the coaxial cable onto the hollow body of the coaxial cable end connector.

To enable a further understanding of the innovations and technological content of the invention herein, the brief description of the views below are followed by the detailed description of the preferred embodiments, which are provided for purposes of reference and elaboration and shall not be construed as any limitation whatsoever of the invention herein.

BRIEF DESCRIPTION OF THE VIEWS

DETAILED DESCRIPTION OF THE PREFERRED EMBODIMENT

Figure 1:
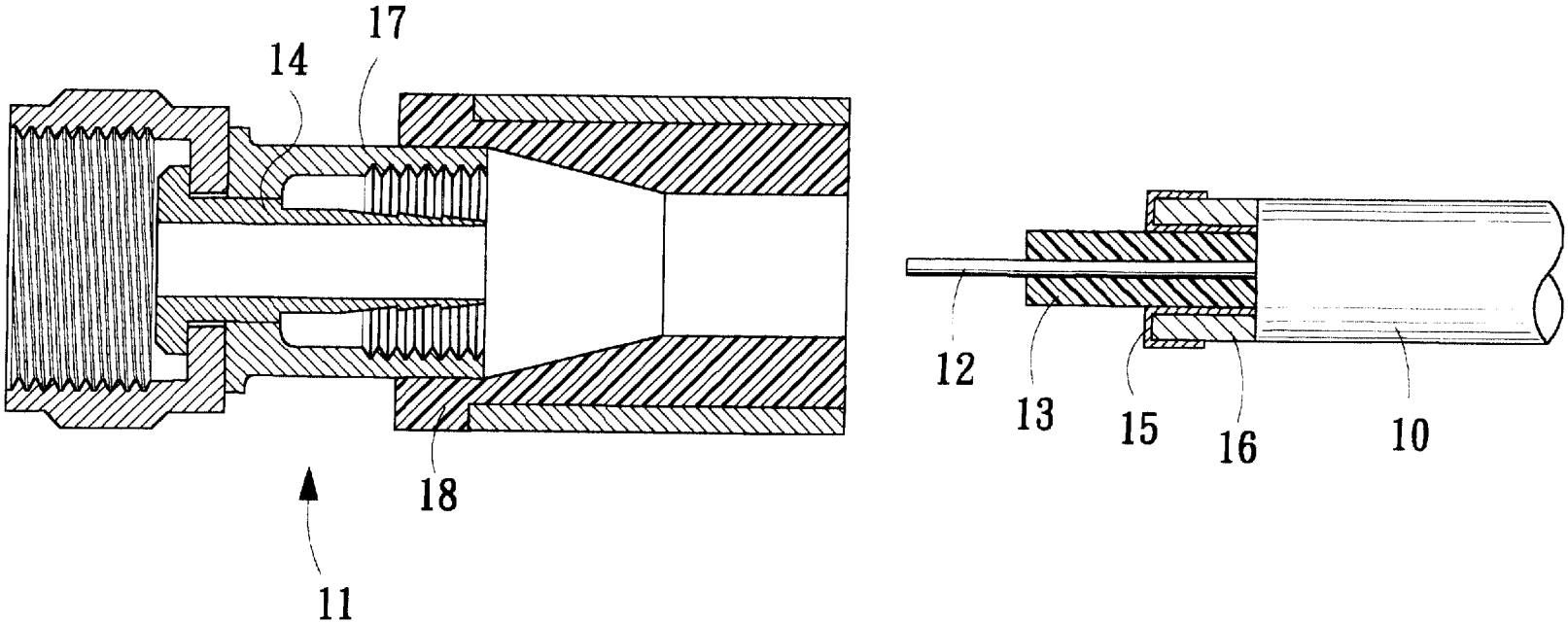
FIG. 1 PRIOR ART
FIG. 1 is a cross-sectional view of an unassembled conventional end connector and a coaxial cable.
Figure 3A:
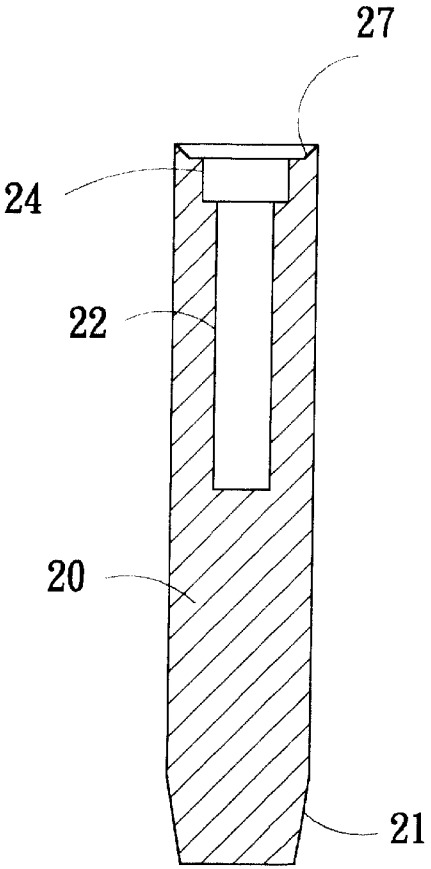
FIG. 3A is a cross-sectional view of the first embodiment of the present invention.
Figure 3:
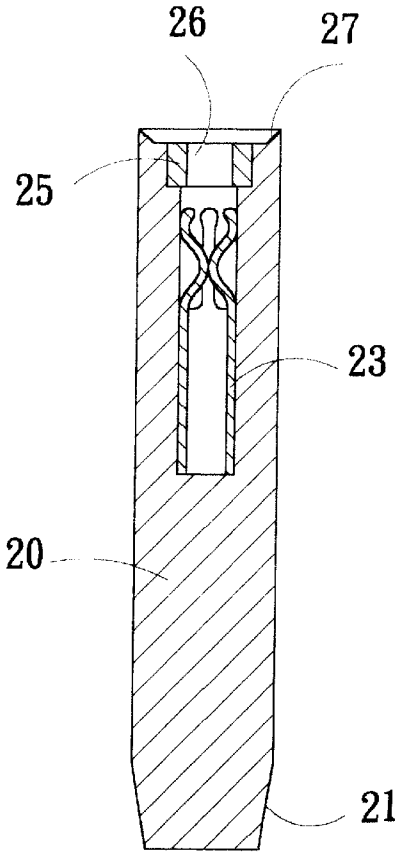
FIG. 3 is a cross-sectional viewing of the present invention taken along line 3—3 of FIG. 2.
Figure 2:
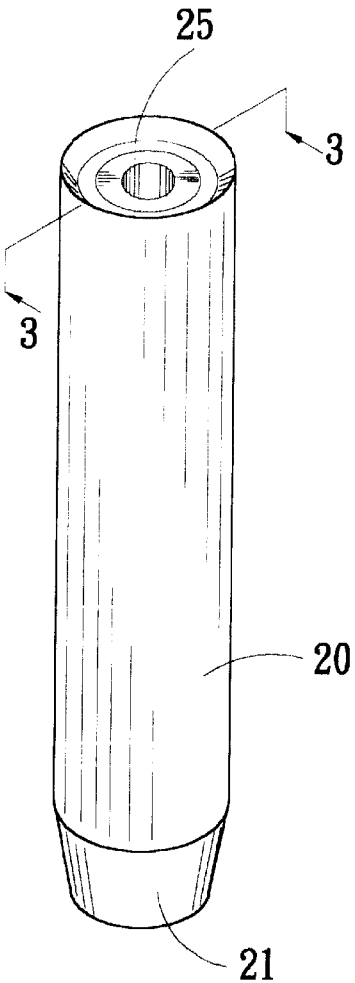
FIG. 2 is a perspective view of the first Embodiment of the invention
Figure 4:
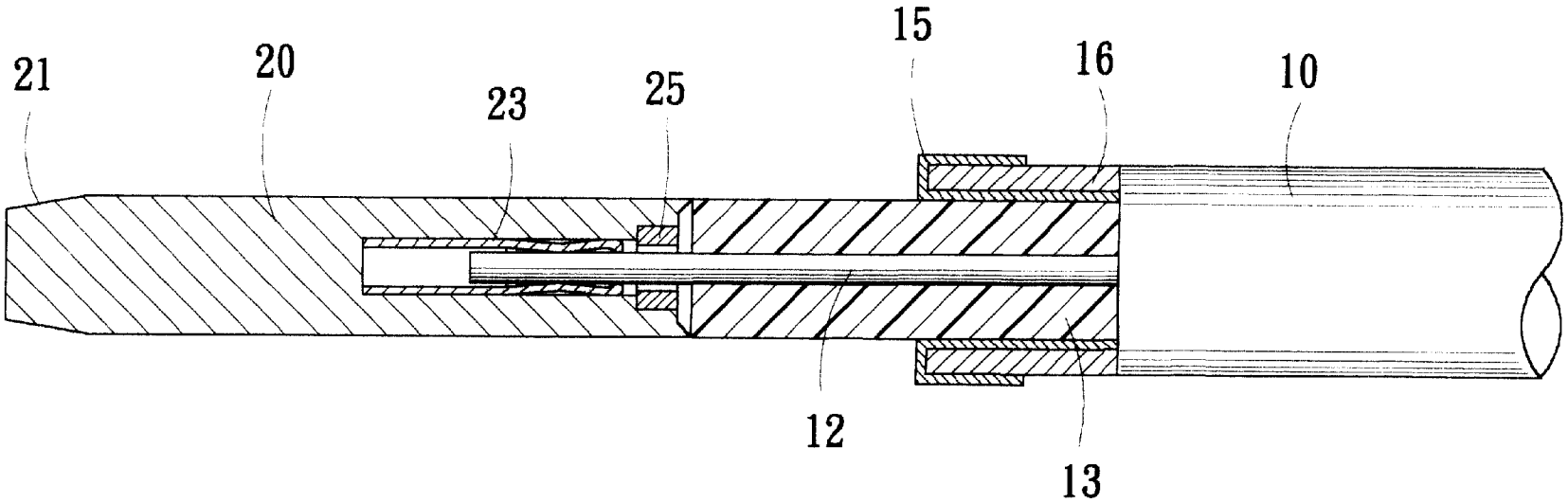
FIG. 4 is a cross-sectional view of the first embodiment of the present invention inserted onto the conductors.
Figure 6A:
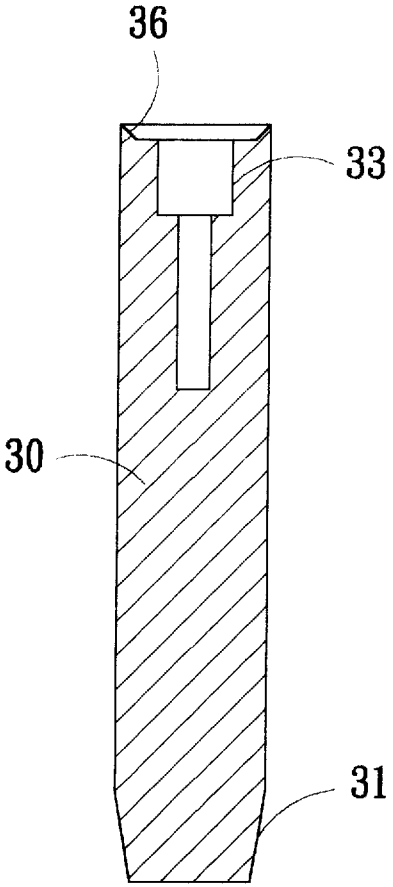
FIG. 6A is a cross-sectional view of the second embodiment of the present invention.
Figure 6:
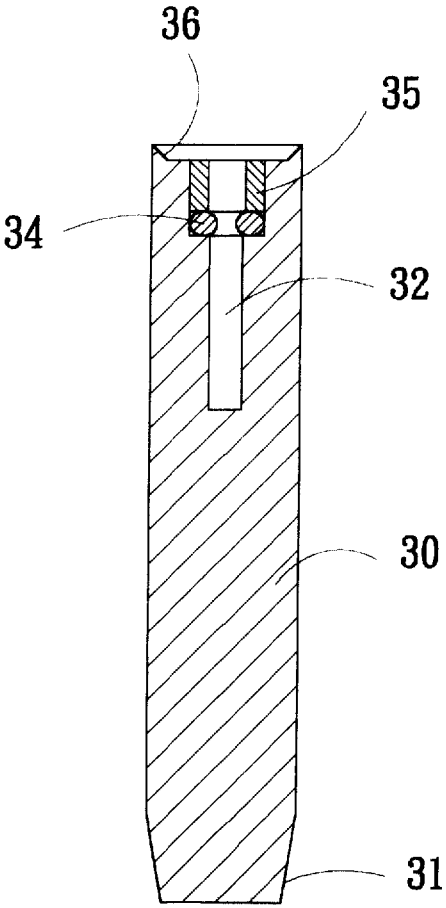
FIG. 6 is a cross-sectional view of the present invention taken alone line of 6—6 of FIG. 5.
Figure 5:
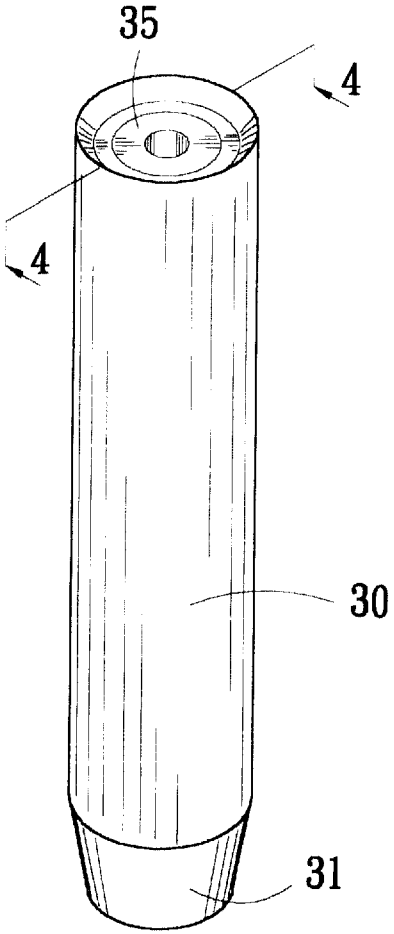
FIG. 5 is a perspective view of the second Embodiment of the present invention
Figure 7:
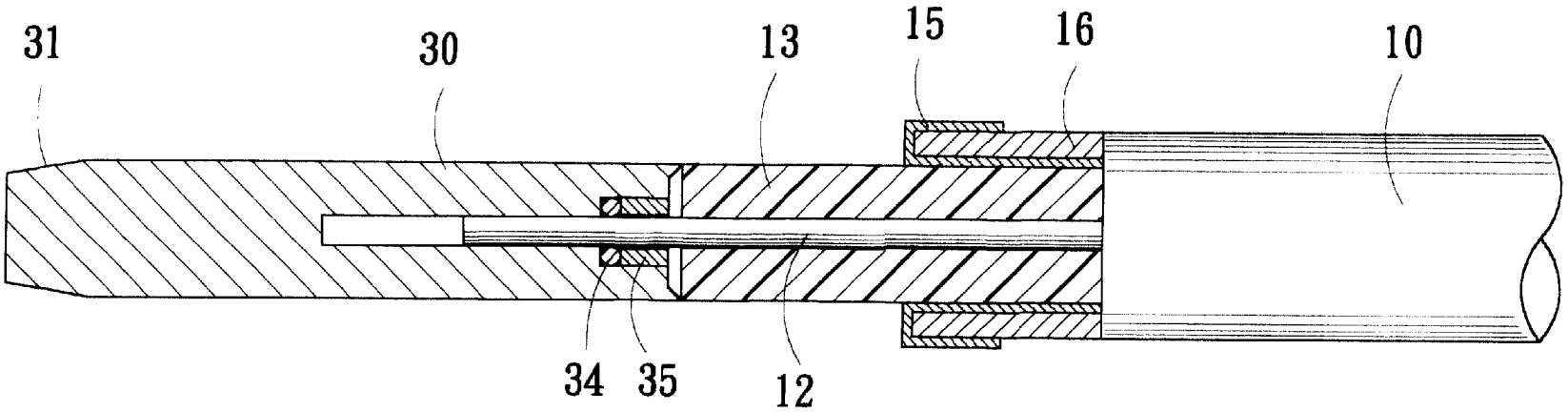
FIG. 7 is a cross-sectional view of the second embodiment of the; present invention ensleeved over the coaxial cable conductors.

Referring to FIG. 2, FIG. 3, FIG. 3A, and FIG. 4, the first embodiment of the present invention is comprised of a body 20 having a beveled surface 21 at one end that is inserted into the hollow body of a coaxial cable end connector; a centered lengthwise tubular passage 22 at the other end, with the tubular passage 22 having an retaining spring 23 situated inside that maintains the placement of the inserted center conductor 12 of the coaxial cable; a circular recess 24 formed contiguous to the outer opening of the said tubular passage 22 that is of a larger diameter than the tubular passage 22, with a bushing 25 positioned in the recess 24 that prevents the dislodging of the retaining spring 23 from the body 20 and, furthermore, there is a hole 26 formed through the center of the said bushing 25 that accommodates the insertion of the center conductor 12; and an annular seat 27 formed contiguously beyond the said recess 24 that is of a larger diameter than the recess 24.

When the center conductor 12 of the coaxial cable is inserted through the middle of first embodiment, the end surface of the dielectric 13 contacts the annular seat 27 and the center conductor 12 enters the retaining spring 23 and, furthermore, extends into the tubular passage 22, causing the outer diametrical extent of the center conductor 12 to become clasped by the retaining spring 23 to prevent separation of the center conductor 12 from the body 20 during installation work and thereby enabling the installation personnel to effectively insert the guide tube of the first Embodiment into the hollow body of the end connector and, furthermore, withdraw the guide tube of the first Embodiment just as easily upon completion of assembly.

Referring to FIG. 5, FIG. 6, FIG. 6A, and FIG. 7, the guide tube of the second Embodiment of the invention herein is comprised of a body 30 having a beveled surface 31 at one end that is inserted into the hollow body of a coaxial cable end connector; a centered lengthwise tubular passage 32 at the other end into which is inserted the center conductor 12 of the coaxial cable; a circular recess 33 formed contiguous to the outer opening of the said tubular passage 32 that is of a larger diameter than the tubular passage 32, with an O-ring 34 and a bushing 35, respectively, positioned in the recess 33 such that after the center conductor 12 is inserted through and held fast by the said O-ring 34, the bushing 35 prevents the bushing 35 from becoming dislodged from the body 30; and an annular seat 36 formed contiguously beyond the said recess 33 that is of a larger diameter than the recess 33.

When the center conductor 12 of the coaxial cable is inserted through the middle of the guide tube of the second Embodiment, the end surface of the dielectric 13 contacts the annular seat 36 and the center conductor 12 enters the O-ring 34 and, furthermore, extends into the tubular passage 32, causing the outer diametrical extent of the center conductor 12 to become restrained by the O-ring 34 to prevent separation of the center conductor 12 from the body 30 during installation work and thereby enabling the installation personnel to effectively insert the guide tube of the second Embodiment into the hollow body of the end connector and, furthermore, withdraw the guide tube of the second Embodiment just as easily upon completion of assembly.

Figure 9:
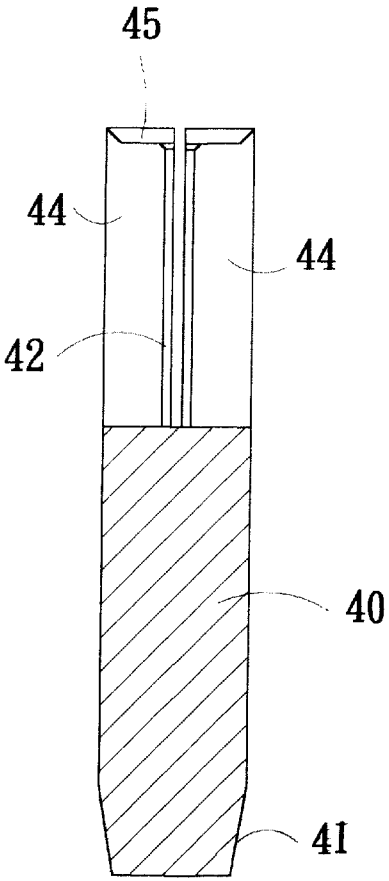
FIG. 9 is a cross-sectional view of the present invention taken alone line 9—9 of FIG. 8.
Figure 8:
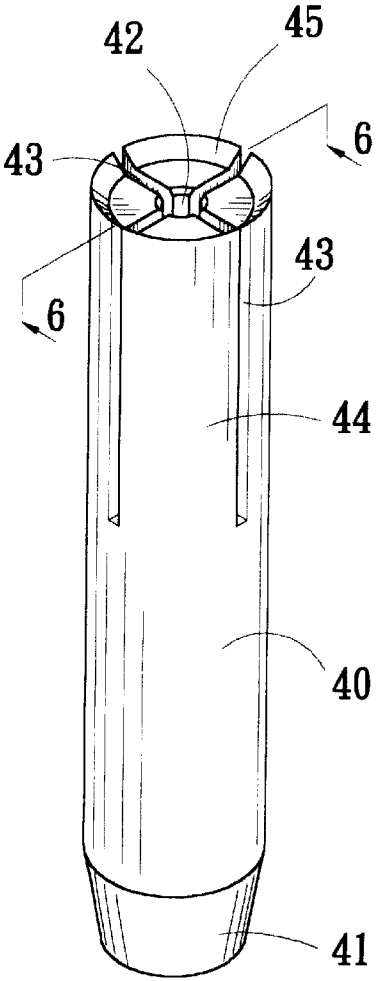
FIG. 8 is cross-sectional view of the third embodiment of the present invention.
Figure 10:
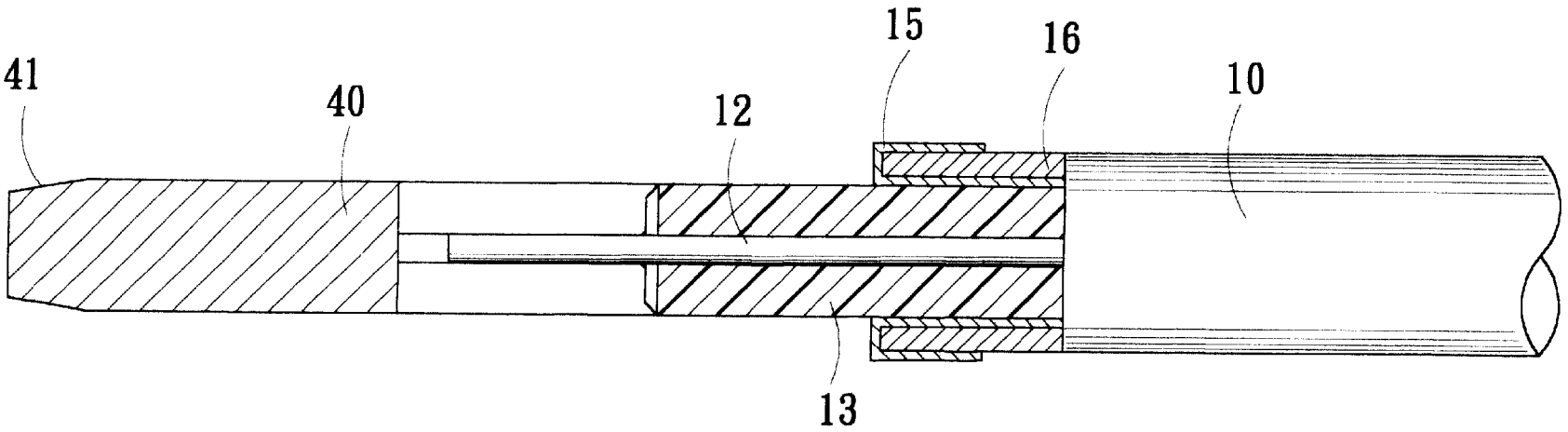
FIG. 10 is a cross-sectional view of the third embodiment of the present invention ensleeved over the coaxial cable conductors.

Referring to FIG. 8, FIG. 9, and FIG. 10, the guide tube of the third Embodiment of the invention herein is comprised of a body 40 having a beveled surface 41 at one end that is inserted into the hollow body of a coaxial cable end connector; a centered lengthwise tubular passage 42 at the other end into which is inserted the center conductor 12 of the coaxial cable; a number of retaining elements 44 formed by the machining of incisions 43 relative to the center line of the tubular passage 42 that serve to secure the inserted center conductor 12; and an annular seat 45 formed contiguously beyond the said tubular passage 42 that is of a larger diameter than the tubular passage 42.

When the center conductor 12 of the coaxial cable is inserted through the middle of the guide tube of the third Embodiment, the end surface of the dielectric 13 contacts the annular seat 45 and the center conductor 12 enters the tubular passage 42 and, furthermore, is extended into the tubular passage 32, causing the outer diametrical extent of the center conductor 12 to become clamped by the retaining elements 44 to prevent separation of the center conductor 12 from the body 40 during installation work and thereby enabling the installation personnel to effectively insert the guide tube of the third Embodiment into the hollow body of the end connector and, furthermore, withdraw the guide tube of the third Embodiment just as easily upon completion of assembly.

Figure 11:
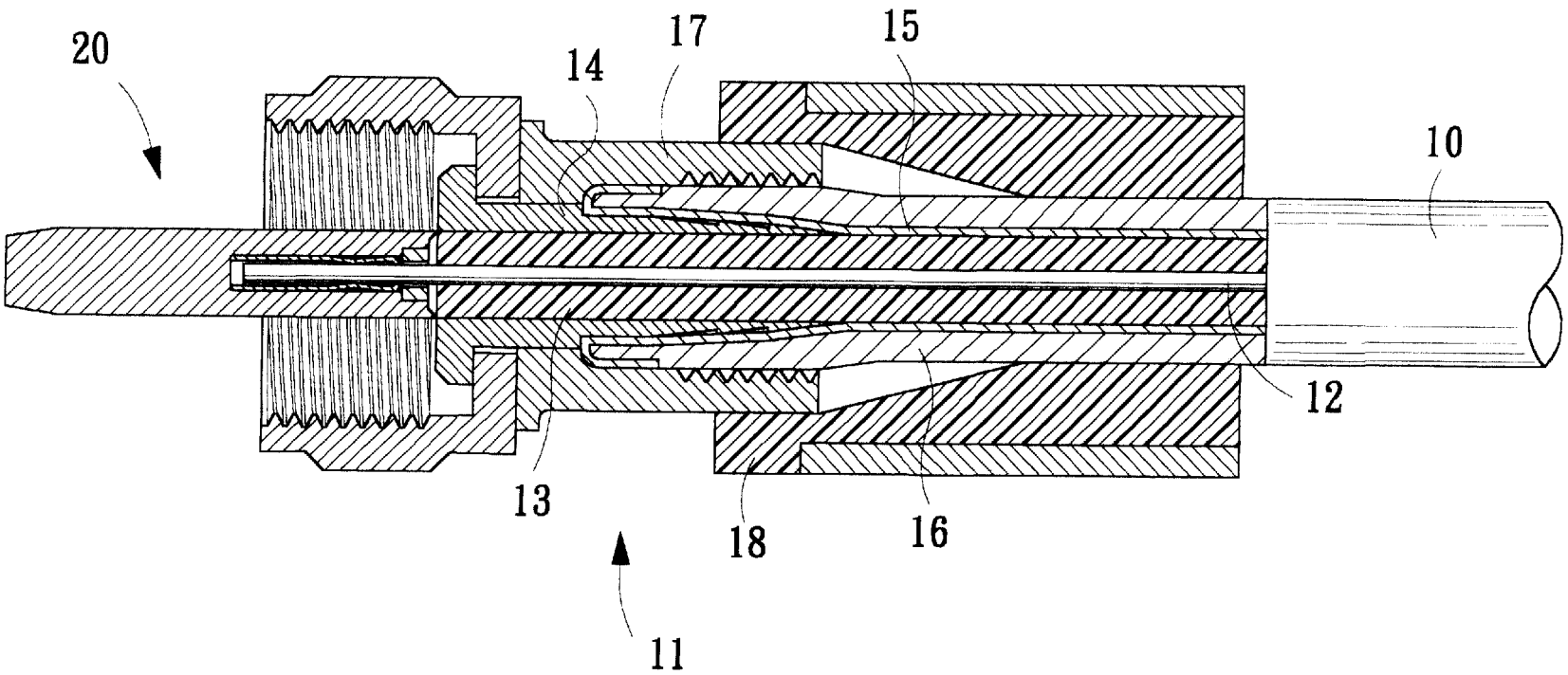
FIG. 11 is a cross-sectional view of the present invention inserted into the end connector.

Referring to FIG. 11, after the said center conductor 12 is inserted into the hollow body 14 of the coaxial cable end connector 11, said guide tube of the invention herein is not only capable of being extended completely through the said end connector 11 and emerge from its opposite end, but is also capable of being withdrawn just as efficiently to accelerate the completion of the installation procedure.

What is claimed is:

1. A guide tube utilized as an assisting component to couple an end connector to a coaxial cable comprising a body having a centered tubular passage with an upper surface and outer opening formed internally at one end of said body into which is inserted the center conductor of a coaxial cable, and a pair of retaining springs situated inside said tubular passage.

2. A guide tube as claimed in claim 1, wherein a recess is formed contiguous to the outer opening of the said tubular passage and a bushing is positioned in said recess.

3. A guide tube utilized as an assisting component to couple an end connector to a coaxial cable comprising a body having a centered tubular passage with an upper surface and outer opening formed internally at one end of said body into which is inserted the center conductor of a coaxial cable, a plurality of incisions machined into said upper surface of said tubular passage to form a number of retaining elements and wherein a recess is formed contiguous to the outer opening of said tubular passage and in which an O-ring and a bushing are positioned in the said recess respectively.

* * * * *